US010916189B2

(12) United States Patent
Cho et al.

(10) Patent No.: US 10,916,189 B2
(45) Date of Patent: Feb. 9, 2021

(54) SCAN DRIVER AND DISPLAY DEVICE USING THE SAME

(71) Applicant: LG Display Co., Ltd., Seoul (KR)

(72) Inventors: Soondong Cho, Paju-si (KR); Hoon Jang, Paju-si (KR); Jongwoo Kim, Paju-si (KR); Juno Hur, Paju-si (KR); Jungjae Kim, Paju-si (KR); Dongju Kim, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/544,032

(22) Filed: Aug. 19, 2019

(65) Prior Publication Data

US 2020/0098312 A1 Mar. 26, 2020

(30) Foreign Application Priority Data

Sep. 12, 2018 (KR) ..... 10-2018-0109259

(51) Int. Cl.

| | |
|---|---|
| ***G09G 3/3225*** | (2016.01) |
| ***G09G 3/3266*** | (2016.01) |
| ***G09G 3/3275*** | (2016.01) |
| ***G09G 3/36*** | (2006.01) |

(52) U.S. Cl.

CPC ..... *G09G 3/3225* (2013.01); *G09G 3/3266* (2013.01); *G09G 3/3275* (2013.01); *G09G 3/3648* (2013.01); *G09G 2310/027* (2013.01); *G09G 2310/0267* (2013.01); *G09G 2310/0286* (2013.01); *G09G 2310/08* (2013.01)

(58) Field of Classification Search

CPC .. G09G 3/2018; G09G 3/2022; G09G 3/3674; G09G 2310/08

See application file for complete search history.

(56) References Cited

U.S. PATENT DOCUMENTS

| | | | | |
|---|---|---|---|---|
| 2005/0001827 | A1* | 1/2005 | Abe | G09G 3/22 345/204 |
| 2007/0159429 | A1* | 7/2007 | Hiroki | G09G 3/3677 345/87 |
| 2009/0284499 | A1* | 11/2009 | Kim | G09G 3/20 345/204 |
| 2012/0212275 | A1* | 8/2012 | Jang | G09G 3/3677 327/295 |

FOREIGN PATENT DOCUMENTS

| | | | |
|---|---|---|---|
| JP | 4476391 | B2 | 6/2010 |
| KR | 10-2005-0008880 | A | 1/2005 |

* cited by examiner

*Primary Examiner* — Kevin M Nguyen
(74) *Attorney, Agent, or Firm* — Polsinelli PC

(57) ABSTRACT

A scan driver comprises a level shifter configured to output varied clock signals that have different frequencies for at least two consecutive periods; and a shift register operating based on the varied clock signals output from the level shifter and outputting scan signals.

17 Claims, 16 Drawing Sheets

SCAN DRIVER AND DISPLAY DEVICE USING THE SAME

CROSS REFERENCE TO RELATED APPLICATION

This application claims the benefit of Korean Patent Application No. 10-2018-0109259, filed on Sep. 12, 2018, which is hereby incorporated by reference in its entirety.

BACKGROUND

Field of the Disclosure

The present disclosure relates to a display device, and more particularly, to a scan driver and a display device using the same.

Description of the Background

With the development of information technology, the market for display devices that are connection media between users and information is growing. Accordingly, display devices such as an organic light emitting display (OLED), a quantum dot display (QDD), a liquid crystal display (LCD) and a plasma display panel (PDP) are increasingly used.

Some of the aforementioned display devices, for example, the LCD or the OLED include a display panel having a plurality of sub-pixels, a driver that outputs driving signals for driving the display panel, and a power supply that generates power to be supplied to the display panel and the driver. Further, the driver includes a scan driver that provides scan signals (or gate signals) to the display panel and a data driver that provides data signals to the display panel.

The above-described display device can display images in such a manner that selected sub-pixels transmit light or directly emit light when driving signals, for example, scan signals and data signals are provided to sub-pixels of the display panel.

However, in some of the aforementioned display devices, since the frequency of a clock signal related to output of a scan driver is fixed, it causes problems due to electromagnetic interference (EMI). Accordingly, it is necessary to solve problems caused by EMI.

SUMMARY

The present disclosure provides a scan driver including a level shifter and a shift register. The level shifter outputs clock signals varied to have different frequencies for at least two consecutive periods. The shift register operates on the basis of the clock signals output from the level shifter and outputs scan signals.

In another aspect, the present disclosure provides a display device including a scan driver, a data driver, a timing controller, and a display panel. The scan driver may output scan signals dispersed in diverse frequency bands. The data driver may output data signals. The timing controller may control the scan driver and the data driver. The display panel may display an image on the basis of the scan signals and the data signals.

BRIEF DESCRIPTION OF THE DRAWINGS

The accompany drawings, which are included to provide a further understanding of the disclosure and are incorporated on and constitute a part of this application illustrate aspects of the disclosure and together with the description serve to explain the principles of the disclosure.

In the drawings.

DETAILED DESCRIPTION

Reference will now be made in detail aspects of the disclosure examples of which are illustrated in the accompanying drawings.

Hereinafter, specific aspects of the disclosure will be described with reference to the attached drawings.

With the development of information technology, the market for display devices that are connection media between users and information is growing. Accordingly, display devices such as a quantum dot display (QDD), a liquid crystal display (LCD), an organic light emitting display (OLED) and a plasma display panel (PDP) are increasingly used.

Some of the aforementioned display devices, for example, the LCD or the OLED include a display panel having a plurality of sub-pixels, a driver which outputs driving signals for driving the display panel, and a power supply which generates power to be supplied to the display panel and the driver. The driver includes a scan driver which provides scan signals (or gate signals) to the display panel and a data driver which provides data signals to the display panel.

The aforementioned display device can display images in such a manner that selected sub-pixels transmit light or directly emit light when driving signals, for example, scan signals and data signals are provided to sub-pixels formed on the display panel. Hereinafter, description relating to the disclosure will be continued using an LCD device and an OLED device as examples. The disclosure described below can also be applied to display devices based on an inorganic light-emitting diode as well as an organic light-emitting diode.

Figure 1:
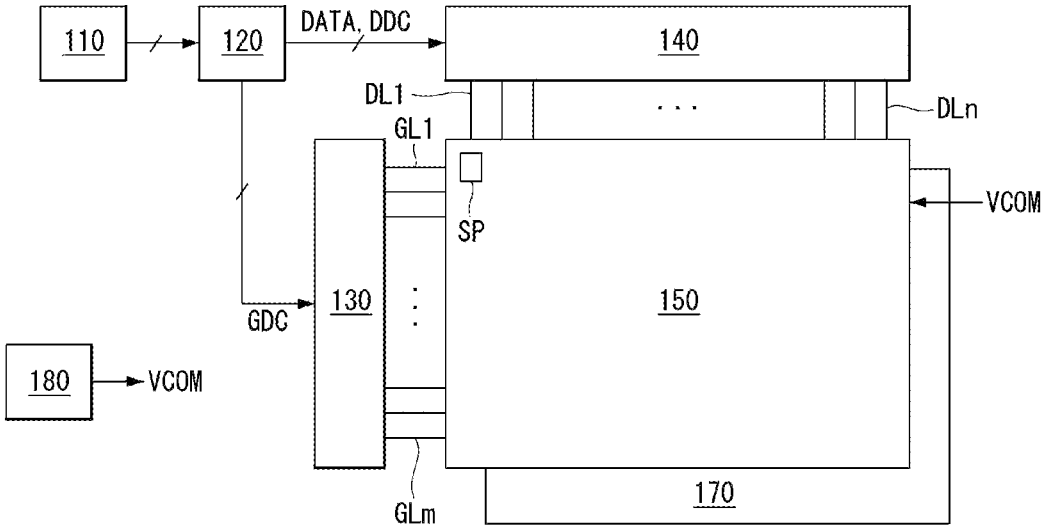
FIG. 1 is a block diagram schematically showing an LCD device.
Figure 2:
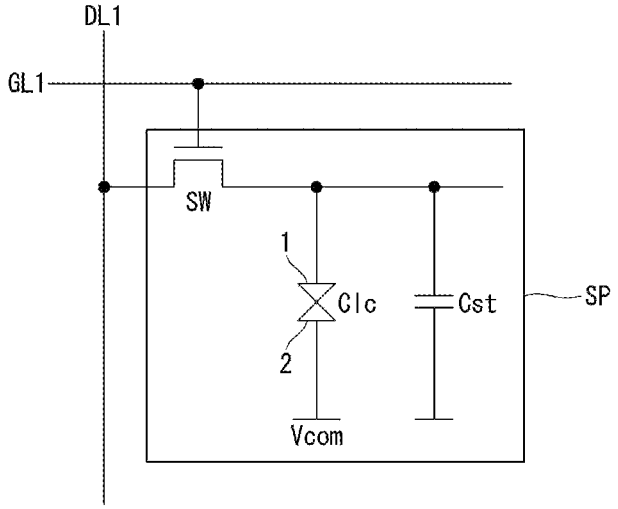
FIG. 2 is a circuit diagram schematically showing a sub-pixel shown in FIG. 1.

FIG. 1 is a block diagram schematically showing an LCD device and FIG. 2 is a circuit diagram schematically showing a sub-pixel shown in FIG. 1.

As shown in FIGS. 1 and 2, the LCD device may include an image provider 110, a timing controller 120, a scan driver 130, a data driver 140, a liquid crystal panel 150, a back light unit 170 and a power supply 180.

The image provider 110 outputs various driving signals along with an image data signal supplied from the outside or an image data signal stored in an internal memory. The image provider 110 provides the data signal and the various driving signals to the timing controller 120.

The timing controller 120 outputs a gate timing control signal GDC for controlling an operation timing of the scan driver 130, a data timing control signal DDC for controlling an operation timing of the data driver 140, and various synchronization signals (e.g., a vertical synchronization signal Vsync and a horizontal synchronization signal Hsync). The timing controller 120 provides the data signal (or a data voltage) DATA supplied from the image provider 110 along with the data timing control signal DDC to the data driver 140.

The scan driver 130 outputs a scan signal (or a gate signal) in response to the gate timing control signal GDC supplied from the timing controller 120. The scan driver 130 provides the scan signal to sub-pixels included in the liquid crystal panel 150 through gate lines GL1 to GLm. The scan driver 130 may be configured in the form of an IC or may be directly formed on the liquid crystal panel 150 in a gate-in-panel structure.

The data driver 140 samples and latches the data signal DATA in response to the data timing control signal DDC supplied from the timing controller 120, converts the digital data signal into an analog data signal on the basis of a gamma reference voltage and outputs the analog data signal. The data driver 140 provides data voltages to the sub-pixels included in the liquid crystal panel 150 through data lines DL1 to DLn. The data driver 140 may be configured in the form of an IC, but the disclosure is not limited thereto.

The power supply 180 generates a common voltage VCOM on the basis of an external input voltage supplied from the outside and outputs the common voltage VCOM. The power supply 180 can generate and output voltages (e.g., a scan high voltage and a scan low voltage) necessary to drive the scan driver 130 and voltages (e.g., a drain voltage and a half drain voltage) necessary to drive the data driver 140 as well as the common voltage VCOM.

The liquid crystal panel 150 displays an image in response to scan signals supplied from the scan driver 130, data voltages supplied from the data driver 140 and the common voltage VCOM supplied from the power supply 180. The sub-pixels of the liquid crystal panel 150 control light provided through the back light unit 170.

For example, one sub-pixel SP includes a switching transistor SW, a storage capacitor Cst and a liquid crystal layer Clc. The gate electrode of the switching transistor SW is connected to a scan line GL1 and the source electrode thereof is connected to a data line DL1. One terminal of the storage capacitor Cst is connected to the drain electrode of the switching transistor SW and the other terminal thereof is connected to a common voltage line Vcom. The liquid crystal layer Clc is formed between a pixel electrode 1 connected to the drain electrode of the switching transistor SW and a common electrode 2 connected to the common voltage line Vcom.

The liquid crystal panel 150 is realized in a twisted nematic (TN) mode, a vertical alignment (VA) mode, an in-plane switching (IPS) mode, a fringe field switching (FFS) mode or an electrically controlled birefringence (ECB) mode according to structures of the pixel electrode 1 and the common electrode 2.

The back light unit 170 provides light to the liquid crystal panel 150 using a light source that emits light. Although the back light unit 170 may include a light-emitting diode (LED) driver which drives LEDs, an LED substrate on which LEDs are mounted, a light guide plate which converts light emitted from LEDs into surface light, a reflector which reflects light under the light guide plate, and optical sheets which condense and spread light emitted from the light guide plate, the disclosure is not limited thereto.

Figure 3:
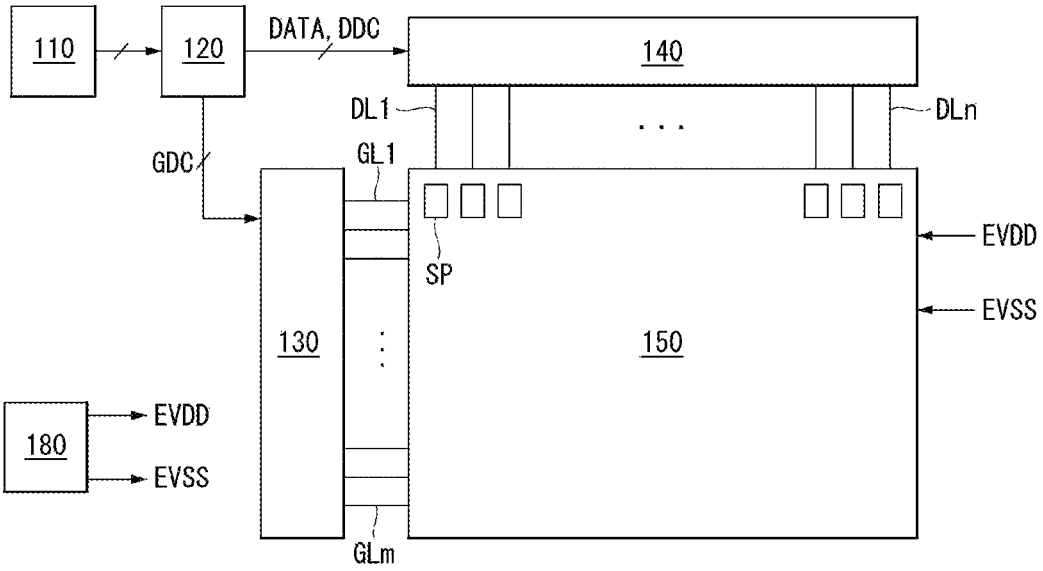
FIG. 3 is a block diagram schematically showing an OLED device.
Figure 4:
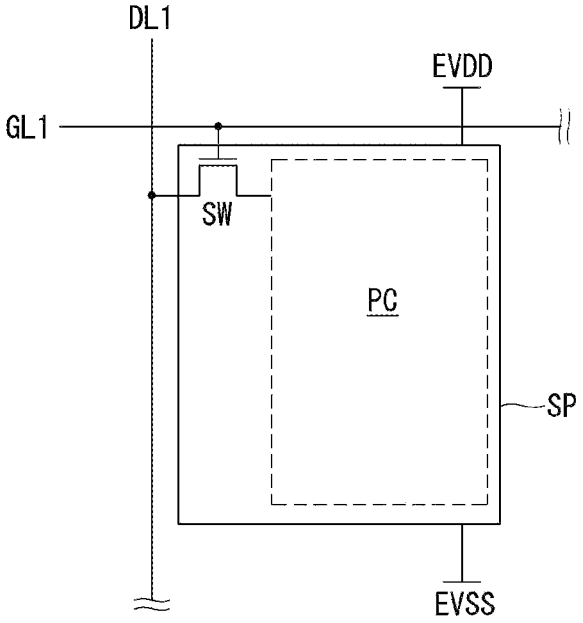
FIG. 4 is a diagram schematically showing a configuration of a sub-pixel shown in FIG. 3.

FIG. 3 is a block diagram schematically showing an OLED device and FIG. 4 is a diagram schematically showing a configuration of a sub-pixel shown in FIG. 3.

As shown in FIGS. 3 and 4, the OLED device may include an image provider 110, a timing controller 120, a scan driver 130, a data driver 140, a display panel 150 and a power supply 170.

Basic configurations and operations of the image provider 110, the timing controller 120, the scan driver 130 and the data driver 140 included in the OLED device are similar to those of the LCD device shown in FIG. 1 and thus detailed description thereof is omitted. Instead, the power supply 180 and the display panel 150 distinguished from those of the LCD will be described in more detail.

The power supply 180 generates a first power voltage EVDD that is a high voltage and a second power voltage EVSS that is a low voltage on the basis of an external input voltage supplied from the outside and outputs the first power voltage EVDD and the second power voltage EVSS. The power supply 180 can generate and output voltages (e.g., a scan high voltage and a scan low voltage) necessary to drive the scan driver 130 and voltages (e.g., a drain voltage and a half drain voltage) necessary to drive the data driver 140 as well as the first and second power voltages EVDD and EVSS.

The display panel 150 displays an image in response to scan signals and data voltages output from drivers including the scan driver 130 and the data driver 140 and the first and second power voltages EVDD and EVSS output from the power supply 180. Sub-pixels of the display panel 150 directly emit light.

For example, one sub-pixel SP includes a switching transistor SW and a pixel circuit PC including a driving transistor, a storage capacitor and an OLED. The sub-pixel SP used in the OLED device directly emits light and thus has a complicated circuit configuration compared to LCDs. Furthermore, not only an OLED emitting light but also a compensation circuit for compensating for deterioration of a driving transistor that supplies driving current to the OLED is configured in complicated and various manners. Accordingly, the pixel circuit PC included in the sub-pixel SP is shown in the form of a block.

Figure 5:
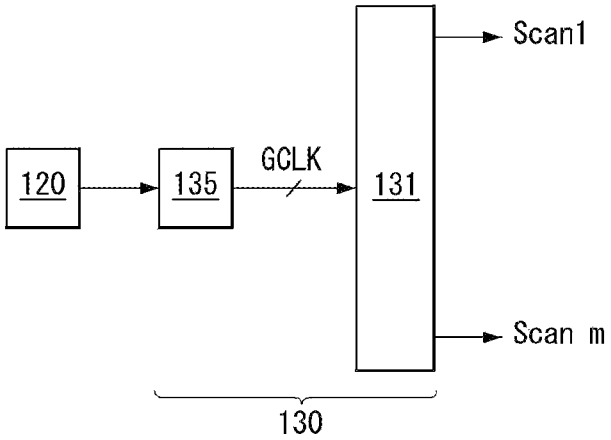
FIG. 5 is a diagram illustrating a first configuration of a device related to a scan driver.
Figure 6:
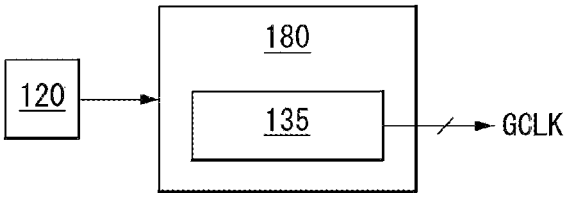
FIG. 6 is a diagram illustrating a second configuration of a device related to a scan driver.

FIG. 5 is a diagram illustrating a first configuration of a device related to a scan driver and FIG. 6 is a diagram illustrating a second configuration of a device related to a scan driver.

The LCD device described with reference to FIGS. 1 and 2 and the OLED device described with reference to FIGS. 3 and 4 charge data voltages on the basis of scan signals output from the scan driver 130.

As shown in FIG. 5, the scan driver 130 can include a shift register 131 and a level shifter 135. The level shifter 135 generates a plurality of clock signals GCLK on the basis of signals output from the timing controller 120 and outputs the clock signals GCLK. The plurality of clock signals GCLK is generated to have N different phases (where N is an integer equal to or greater than 2) such as 2 phases, 4 phases or 8 phases, for example.

The shift register 131 operates on the basis of the plurality of clock signals GCLK output from the level shifter 135 and outputs signals Scan 1 to Scan m. Accordingly, output timing and driving reliability of the scan signals Scan 1 to Scan m output from the scan driver 130 can be considered to depend on the clock signal GCLK.

The level shifter 135 is configured in the form of an IC, whereas the shift register 131 is configured in the form of a thin film in a gate-in-panel structure. That is, a part of the scan driver 130 which is formed on the display panel is the shift register 131.

Distinguished from the shift register 131, the level shifter 135 is configured in the form of an IC. Accordingly, the level shifter 135 can be configured in the form of a separate IC as shown in FIG. 5 and may be included in the power supply 180, as shown in FIG. 6.

Hereinafter, an aspect of the disclosure which can solve problems that can be caused in an experimental example using 4-phase clock signals GCLK as an example will be described.

Figure 7:
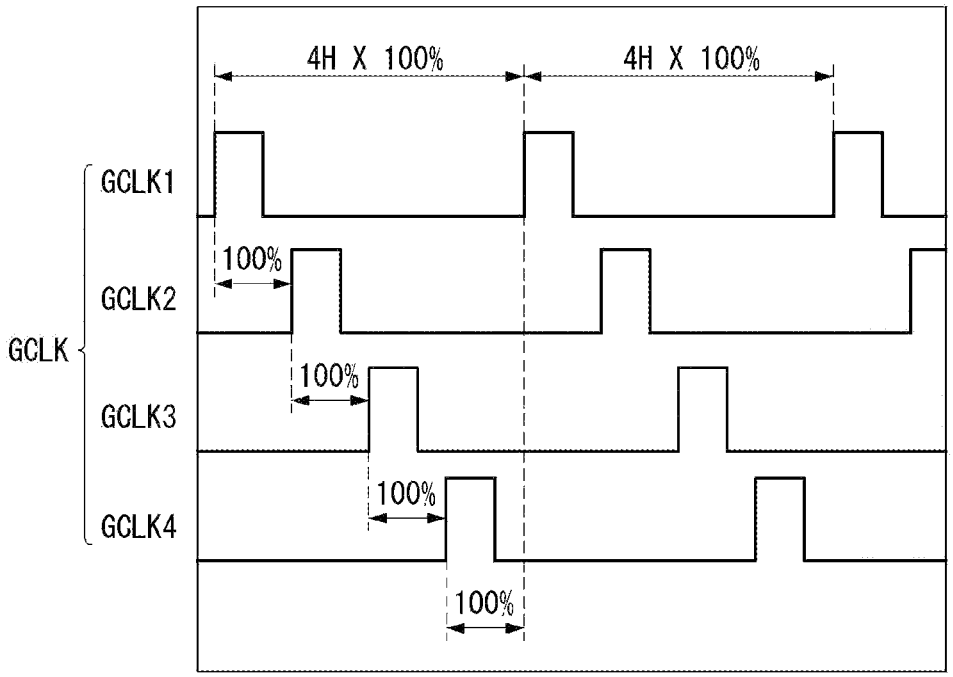
FIG. 7 is a diagram showing an example of a configuration of clock signals according to an experimental example.
Figure 8:
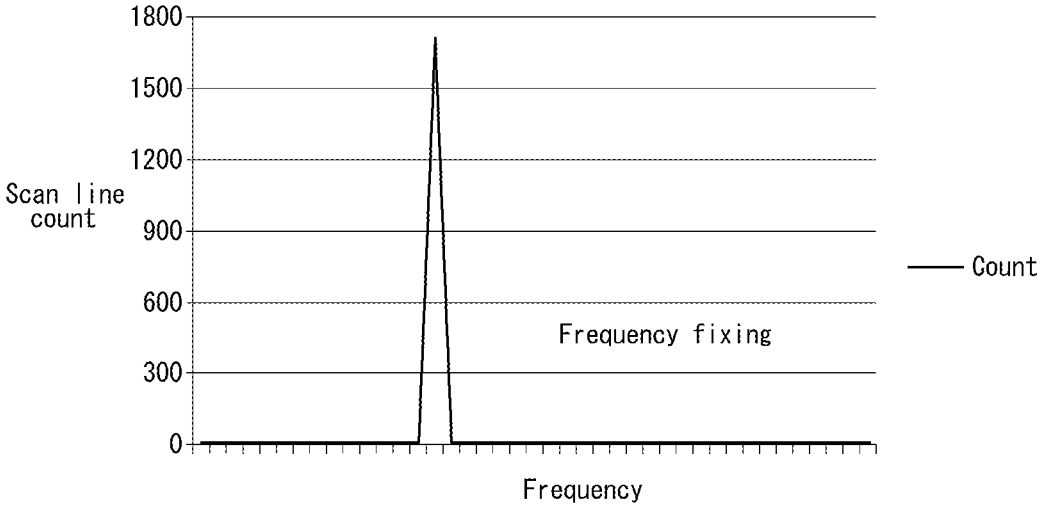
FIG. 8 is a diagram for describing problems of a scan driver realized on the basis of fixed clock signals according to the experimental example.

FIG. 7 is a diagram showing an example of a configuration of clock signals according to an experimental example and FIG. 8 is a diagram for describing problems of a scan driver realized on the basis of fixed clock signals according to the experimental example.

As shown in FIG. 7, clock signals GCLK according to the experimental example are configured to have 4 phases. The 4-phase clock signals GCLK1 to GCLK4 have logic high levels occurring once in a period of 4 horizontal times 4H and maintain a logic low for the remaining time. Here, the first to fourth clock signals GCLK1 to GCLK4 have logic high levels having the same pulse width as represented by 100%. Further, the first to fourth clock signals GCLK1 to GCLK4 have the same pulse width and are continuously fixed to the same frequency form in two consecutive periods as represented by 4H×100%.

When a scan driver is realized on the basis of the clock signals GCLK having a fixed frequency and all scan lines are continuously counted for one frame, data as shown in FIG. 8 is obtained. As can be ascertained through the graph of FIG. 8, a scan signal fixed to a specific frequency band is output when a scan driver is realized on the basis of the clock signals GCLK having a fixed frequency.

However, when the scan driver is realized on the basis of the clock signals GCLK having a fixed frequency as in the experimental example and exposed to electromagnetic waves, the scan driver is vulnerable to electromagnetic interference (EMI). This is improved as follows.

Figure 9:
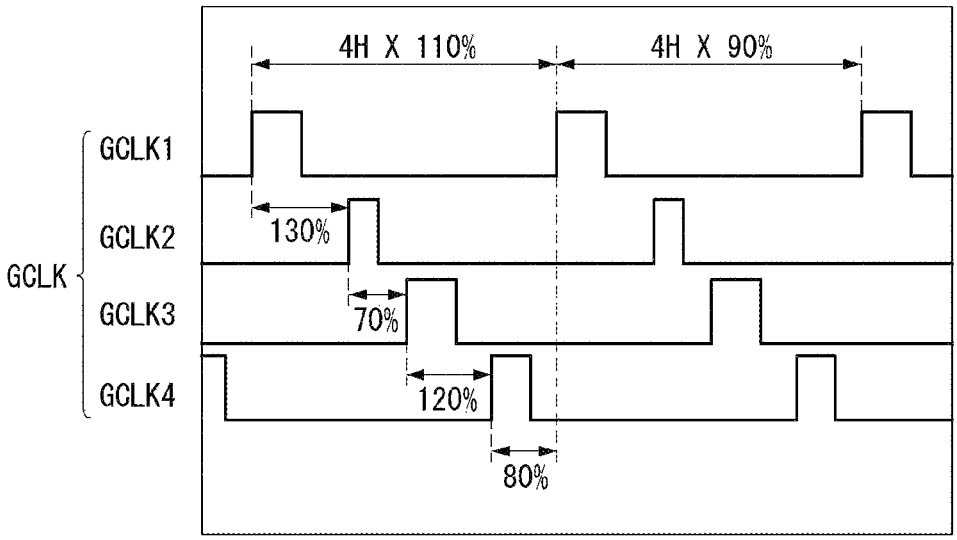
FIG. 9 is a diagram showing an example of a configuration of clock signals according to an aspect of the present disclosure.
Figure 10:
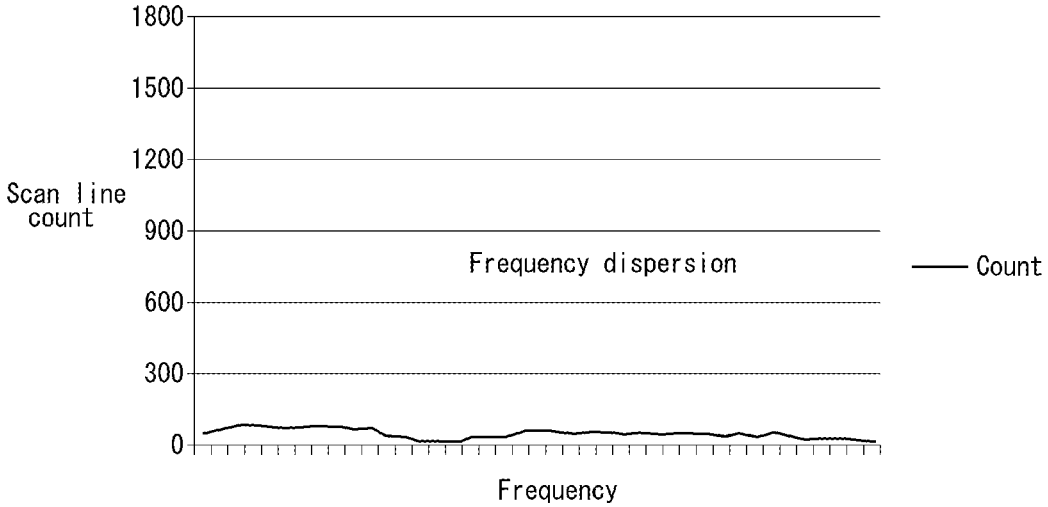
FIG. 10 is a diagram for describing improvements of a scan driver realized on the basis of clock signals varied according to an aspect of the present disclosure.

FIG. 9 is a diagram showing an example of a configuration of clock signals according to an aspect of the disclosure and FIG. 10 is a diagram for describing improvements of a scan driver realized on the basis of clock signals varied according to an aspect of the disclosure.

As shown in FIG. 9, clock signals GCLK according to an aspect of the disclosure are configured to have 4 phases. The 4-phase clock signals GCLK1 to GCLK4 have logic high levels occurring once in a period of 4 horizontal times 4H and maintain a logic low for the remaining time. Here, the first to fourth clock signals GCLK1 to GCLK4 have logic high levels having different pulse widths as represented by 130%, 70%, 120% and 80%. In addition, the first to fourth clock signals GCLK1 to GCLK4 have different pulse widths and are varied to have different frequencies for at least two periods such as two consecutive periods represented by 4H×110% and 4H×90%. That is, periods as well as clocks are modulated in order to distribute frequencies of the first to fourth clock signals GCLK1 to GCLK 4 in the aspect of the disclosure.

When a scan driver is realized on the basis of varied clock signals GCLK and all scan lines are continuously counted for one frame as in the aspect of the disclosure, data as shown in FIG. 10 is obtained. As can be ascertained through the graph of FIG. 10, when a scan driver is realized on the basis of clock signals GCLK having varied frequencies, a scan signal dispersed to various frequency bands (a plurality of frequency bands having at least two different frequency bands) without being fixed to a specific frequency band are output.

When a scan driver is realized on the basis of clock signals GCLK having continuously varying frequencies as in the aspect of the disclosure and exposed to electromagnetic waves, the scan driver is robust against EMI and thus a problem of vulnerability to EMI can be solved.

This is because an EMI factor (low frequency or high frequency) generated inside or outside a display device and a problem occurring when clock signals overlap in a certain frequency band are considerably eliminated according to frequency dispersion of the clock signals GCLK.

Meanwhile, to vary clock signals such that they have different frequencies for at least two periods, a method of varying a duty ratio between periods, a method of shifting phases, a method of delaying phases, and the like can be used. Here, a range in which periods are varied can be ±10% to ±1% but the disclosure is not limited thereto.

For example, the first to fourth clock signals GCLK1 to GCLK4 can be configured such that logic high levels having different pulse widths are generated at the rate of 4H×110% in the first period and logic high levels having different pulse widths are generated at the rate of 4H×90% in the second period, but the disclosure is not limited thereto.

Therefore, clock signals GCLK1 to GCLK4 in a first group are generated in the first period, clock signals GCLK1 to GCLK4 in a second group are generated in the second period, and clock signals GCLK1 to GCLK4 having different pulse widths and periods in a group are generated in an M-th period.

Although a scan signal can be dispersed to the most diverse frequency bands when the clock signals GCLK1 to GCLK4 are varied as in the aspect of the disclosure, the method described below may also be considered.

Figure 11:
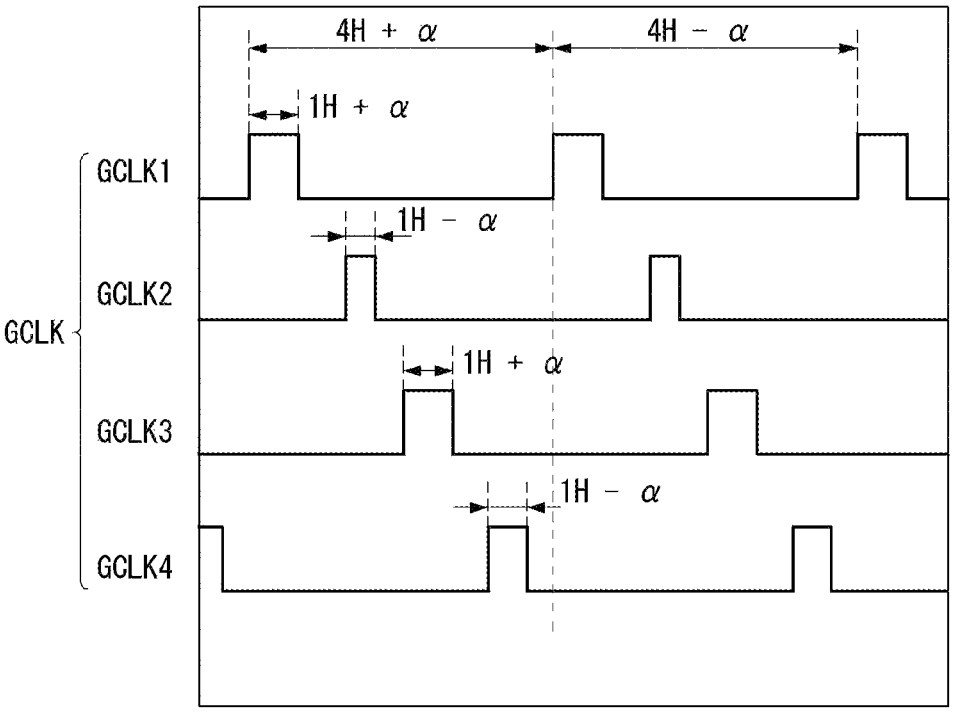
FIGS. 11 to 13 are diagrams for describing an example of modulation of clock signals according to another aspect of the present disclosure.
Figure 12:
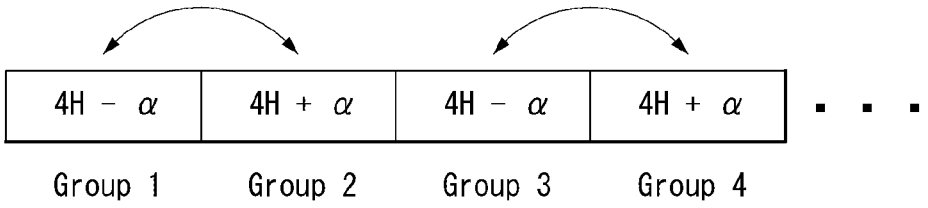
Figure 13:
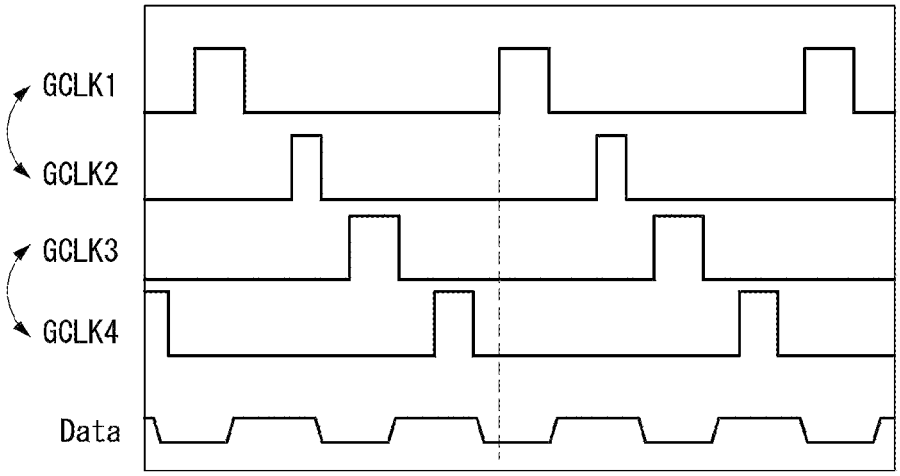

FIGS. 11 to 13 are diagrams for describing an example of modulation of clock signals according to another aspect of the disclosure.

As shown in FIG. 11, clock signals GCLK according to another aspect of the disclosure are also configured to have 4 phases. The 4-phase clock signals GCLK1 to GCLK4 A respectively have logic high levels occurring once in a period of 4 horizontal times 4H and maintain logic low levels for the remaining time. Here, the pulse width of the logic high level increases to "1H+α" in the first clock signal GCLK1, but the pulse width of the logic high level may decrease to "1H−α" in the second clock signal GCLK2 adjacent to the first clock signal GCLK1. Similarly, the pulse width of the logic high level increases to "1H+α" in the third clock signal GCLK3, whereas the pulse width of the logic high level may decrease to "1H-α" in the fourth clock signal GCLK4 adjacent to the third clock signal GCLK3.

As can be ascertained through the aforementioned relationship between the first clock signal GCLK1 and the second clock signal GCLK2 and relationship between the third clock signal GCLK3 and the fourth clock signal GCLK4, two clock signals in the same period can be assigned as a pair and modulation (complementary modulation) of decreasing the pulse width of one of the clock signals when the pulse width of the other increases can be executed. This is associated with a data signal charging rate, which will be described below.

However, the aforementioned method is merely an example, and the pulse width of the logic high level of the first clock signal GCLK1 may decrease whereas the pulse width of the logic high level of the second clock signal GCLK2 may increase and the pulse width of the logic high level of the third clock signal GCLK3 may decrease whereas the pulse width of the logic high level of the fourth clock signal GCLK4 may increase within the same period. That is, the clock signals GCLK1 to GCLK4 may be modulated in a manner reverse to that shown in FIG. 11.

Furthermore, the clock signals GCLK may be modulated such that the logic high levels of the first clock signal GCLK1 and the third clock signal GCLK3 have the same pulse width and the logic high levels of the second clock signal GCLK2 and the fourth clock signal GCLK4 have the same pulse width within the same period or the logic high level of at least one of the clock signals GCLK1 to GCLK4 has a different pulse width.

Although the clock signals GCLK may be modulated such that the logic high level of at least one of the clock signals GCLK1 to GCLK4 has a different pulse width as described above, the period also needs to be varied as represented as 4H+α and 4H−α for dispersion to various frequency bands.

As shown in FIG. 12, two neighboring groups are modulated in a pair. For example, the first and second groups are paired and the third and fourth groups are paired. Periods increase/decrease in such a manner that when the period of the first group decreases to 4H−α, the period of the second group neighboring the first group increases to 4H+α.

As described above, as can be ascertained through the example of the first to fourth groups, modulation (complementary modulation) through which, when one of two consecutive periods increases, the other decreases can be achieved for the two consecutive periods (two groups are paired).

As shown in FIG. 13, pulse width modulation can be executed for the first and second clock signals GCLK1 and GCLK2 which are paired and for the third and fourth clock signals GCLK3 and GCLK4 which are paired. That is, periods can be varied and clock signals in each period can also be varied in pairs.

The reason why neighboring groups (periods) and neighboring clock signals are modulated (frequency modulated) in pairs as described above is that changes in charging time of a data signal Data due to modulation of clock signals cannot be ignored (a charging rate of the data signal Data can be reduced when a problem that output timing of scan signals is delayed or advanced in an undesired direction is caused by modulation of clock signals). Accordingly, it can be ascertained that the method of modulating clock signals according to the disclosure takes not only EMI improvement but also a charging rate of a data signal Data into account.

Hereinafter, circuit configurations and frequency dispersion methods according to circuits for realizing aspects of the disclosure will be described.

Figure 14:
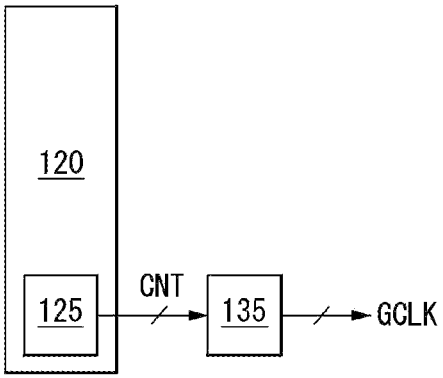
FIG. 14 is a diagram showing configurations of a timing controller and a level shifter according to an aspect of the present disclosure.
Figure 15:
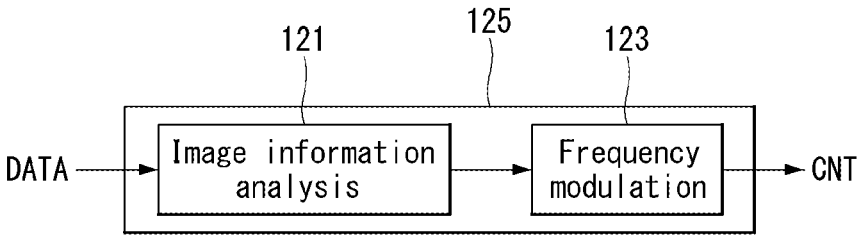
FIG. 15 is a diagram showing a first example of a clock signal controller according to an aspect of the present disclosure.
Figure 16:
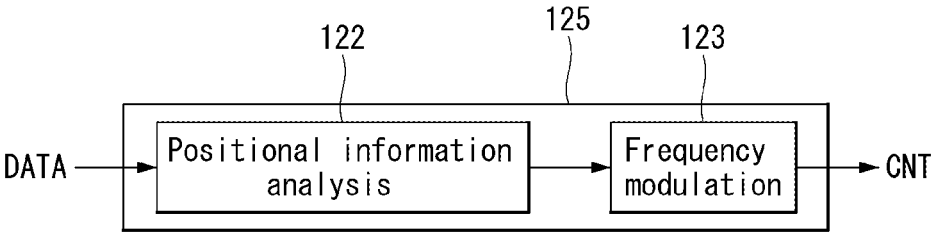
FIG. 16 is a diagram showing a second example of the clock signal controller according to an aspect of the present disclosure.
Figure 17:
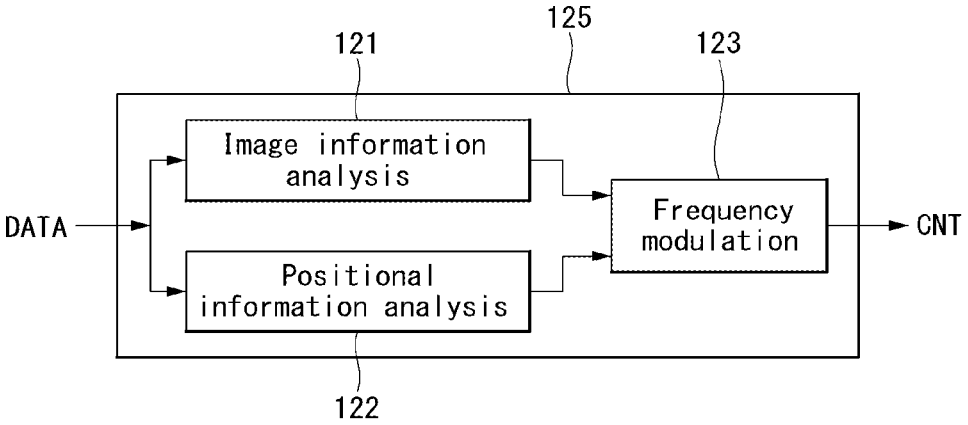
FIG. 17 is a diagram showing a third example of the clock signal controller according to an aspect of the present disclosure.

FIG. 14 is a diagram showing configurations of a timing controller and a level shifter according to an aspect of the present disclosure, FIG. 15 is a diagram showing a first example of a clock signal controller according to an aspect of the present disclosure, FIG. 16 is a diagram showing a second example of the clock signal controller according to an aspect of the present disclosure, and FIG. 17 is a diagram showing a third example of the clock signal controller according to an aspect of the present disclosure.

As shown in FIG. 14, the timing controller 120 includes a clock signal controller 125. The clock signal controller 125 generates and outputs a clock signal control signal CNT. The level shifter 135 varies frequencies of clock signals GCLK in response to the clock signal control signal CNT and outputs the clock signals GCLK.

The clock signal controller 125 varies the frequencies of the clock signals on the basis of the clock signal control signal CNT and can control frequency modulation ranges of scan signals applied to a center area, an upper area and a lower area of a display panel such that they are different (i.e., differential dispersion by area).

When the clock signal controller 125 is included in the timing controller 120, the clock signal control signal CNT can be configured to have an on clock for controlling a logic high duration and an off clock for controlling a logic low duration. However, the disclosure is not limited thereto. In addition, the clock signal controller 125 may be provided in the form of a separate IC outside the timing controller 120. The clock signal control signal composed of an on clock and an off clock will be described below.

As shown in FIGS. 14 and 15, the clock signal controller 125 may include an image information analyzer 121 and a frequency modulator 123. The image information analyzer 121 analyzes an image on the basis of a data signal DATA input to the timing controller 120 and various synchronization signals (e.g., Vsync and Hsync) and outputs a frequency modulation value according to analysis results. The frequency modulator 123 generates a clock signal control signal CNT that can cause frequency dispersion in response to an image displayed on the display panel on the basis of the frequency modulation value output from the positional information analyzer 122 and outputs the clock signal control signal CNT.

According to the first example, the image information analyzer 121 can analyze an image to be displayed on the display panel to determine whether the image is a still image or a moving image (i.e., screen pattern analysis), and the clock signal control signal CNT that can adaptively vary frequencies of clock signals GCLK in accordance with characteristics of the image can be output.

As shown in FIGS. 14 and 16, the clock signal controller 125 may include a positional information analyzer 122 and the frequency modulator 123. The positional information analyzer 122 outputs a frequency modulation value on the basis of a data signal DATA input to the timing controller 120, various synchronization signals (e.g., Vsync and Hsync) and/or resolution data of the display panel. The frequency modulator 123 generates a clock signal control signal CNT that can cause frequency dispersion in response to the position of the display panel on the basis of the frequency modulation value output from the positional information analyzer 122 and outputs the clock signal control signal CNT.

According to the second example, it is possible to output the clock signal control signal CNT that can vary frequencies of clock signals GCLK in accordance with characteristics of an external environment and/or an internal environment of the display panel according to the positional information analyzer 122.

As shown in FIGS. 14 and 17, the clock signal controller 125 may include the image information analyzer 121, the positional information analyzer 122 and the frequency modulator 123. The image information analyzer 121 analyzes an image on the basis of a data signal DATA input to the timing controller 120 and various synchronization signals (e.g., Vsync and Hsync) and outputs a first frequency modulation value.

The positional information analyzer 122 outputs a second frequency modulation value on the basis of the data signal DATA input to the timing controller 120, various synchronization signals (e.g., Vsync and Hsync) and/or resolution data of the display panel.

The frequency modulator 123 generates a clock signal control signal CNT that can cause frequency dispersion in response to an image displayed on the display panel and frequency dispersion in response to the position of the display panel on the basis of the first and second frequency modulation values output from the image information analyzer 121 and the positional information analyzer 122 and outputs the clock signal control signal CNT.

According to the third example, it is possible to output the clock signal control signal CNT that can vary frequencies of clock signals GCLK in accordance with characteristics of an image to be displayed on the display panel and characteristics of an external environment and/or an internal environment of the display panel according to the image information analyzer 121 and the positional information analyzer 122.

As can be ascertained from FIG. 14, the clock signal control signal CNT output from the frequency modulator 123 varies clock signals and causes frequencies of scan signals to be dispersed on the basis of the clock signals, and thus the clock signal control signal CNT is supplied to the level shifter 135 used for frequency dispersion.

Frequency dispersion of clock signals leads to frequency dispersion of scan signals. Hereinafter, examples related to frequency dispersion on the basis of clock signals used for frequency dispersion will be described.

Figure 18:
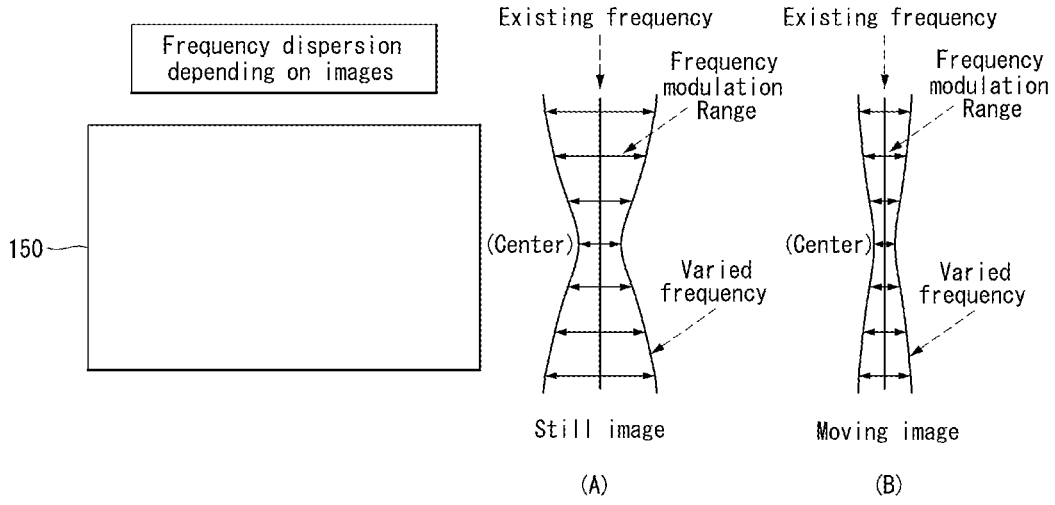
FIG. 18 is a diagram showing frequency dispersion of clock signals according to images.
Figure 19:
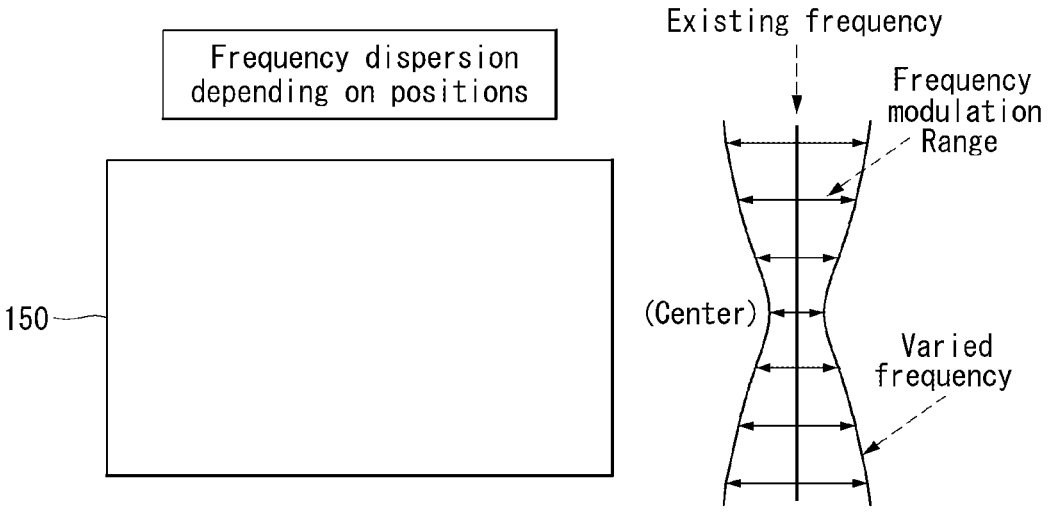
FIG. 19 is a diagram showing a first example of frequency dispersion of clock signals according to positions.
Figure 20:
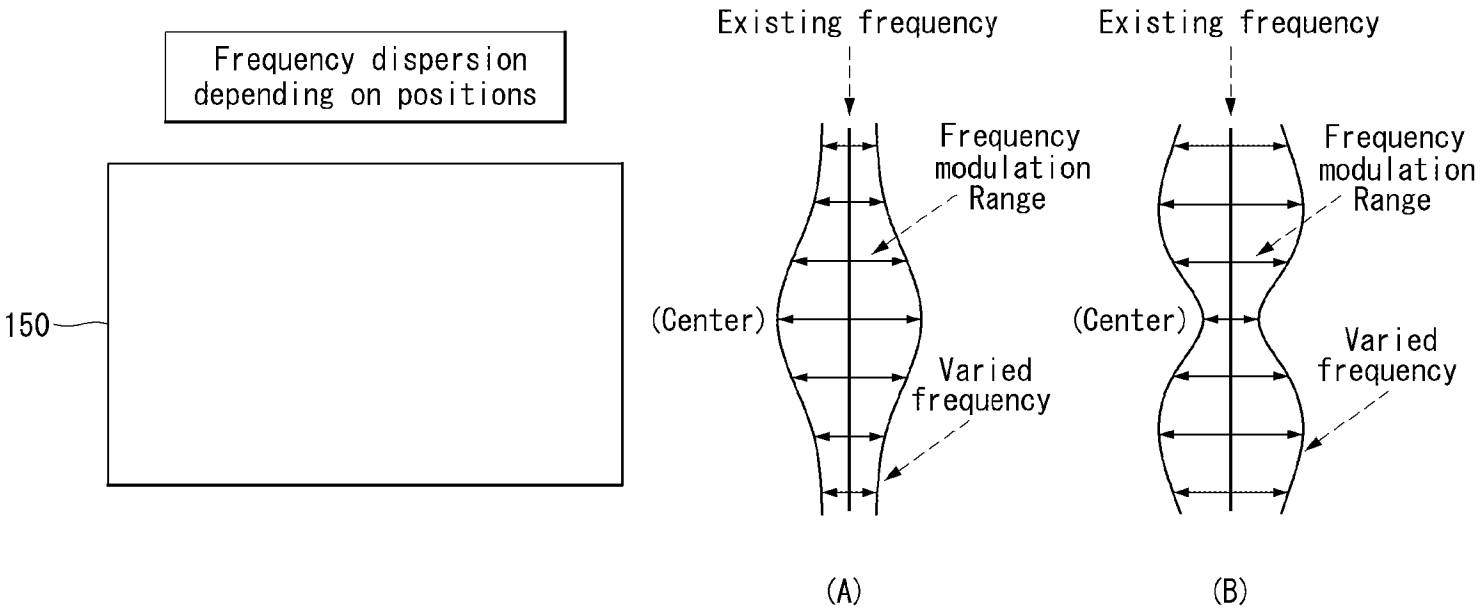
FIG. 20 is a diagram showing a second example of frequency dispersion according to positions.
Figure 21:
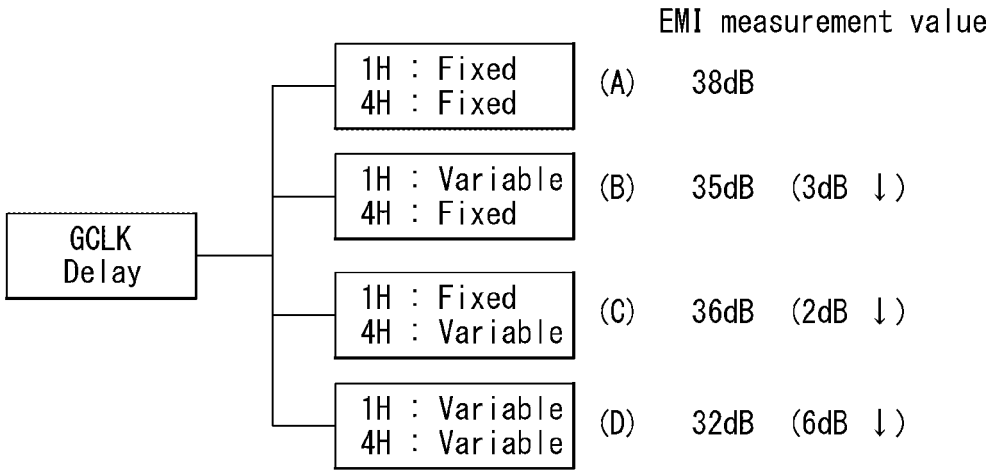
FIG. 21 consists of diagrams showing methods of fixing/dispersing frequencies of clock signals and electromagnetic interference measurement results.

FIG. 18 is a diagram showing frequency dispersion of clock signals depending on images, FIG. 19 is a diagram showing a first example of frequency dispersion of clock signals depending on positions, FIG. 20 is a diagram showing a second example of frequency dispersion depending on positions, and FIG. 21 is a diagram showing methods of fixing/dispersing frequencies of clock signals and EMI measurement results.

As shown in FIG. 18, according to an aspect of the disclosure, frequency dispersion of clock signals depending on an image of the display panel 150 can be achieved. A case in which a still image is displayed as shown in the (A) diagram of FIG. 18, and a case in which a moving image is displayed as shown in the (B) diagram of FIG. 18 can be exemplified for description of frequency dispersion of clock signals depending on images.

First, when a still image is displayed as shown in the (A) diagram FIG. 18, an existing frequency according to the experimental example is fixed, whereas a frequency according to the aspect is varied for at least one period.

As can be ascertained through the illustrated varied frequency, a modulation range (i.e., frequency modulation range) increases with decreasing distance from the center area of the display panel 150 to the ends of the upper area and the lower area. Here, modulation ranges of the upper area and the lower area of the display panel 150 have the same value on the basis of the center area and can gradually increase. On the contrary, the frequency may be varied in a form in which the center area of the display panel 150 is protruded more than the upper area and the lower area of the display panel 150.

Next, when a moving image is displayed as shown in the (B) diagram FIG. 18, an existing frequency according to the experimental example is fixed, whereas a frequency according to the aspect is varied for at least one period.

As can be ascertained through the illustrated varied frequency, a modulation range (i.e., frequency modulation range) increases with decreasing distance from the center area of the display panel 150 to the ends of the upper area and the lower area. Here, modulation ranges of the upper area and the lower area of the display panel 150 have the same value on the basis of the center area and can gradually increase. On the contrary, the frequency may be varied in a form in which the center area of the display panel 150 is protruded more than the upper area and the lower area of the display panel 150.

Meanwhile, as can be ascertained through comparison between the still image of diagram (A) and the moving image of diagram (B) and depicted in FIG. 18, the modulation range (i.e., frequency modulation range) of the still image is greater than that of the moving image in the entire display panel 150 even if frequencies are varied as described above.

To explain the above reason, data signals of a moving image continuously change, whereas data signals of a still image do not continuously change but are maintained and thus only refresh of scan signals is intermittently performed. Accordingly, the moving image requires the data signals to continuously change, and thus a data signal charging rate needs to be further taken into account differently from the still image. Therefore, modulation ranges (frequency modulation ranges) for frequency dispersion of clock signals can be represented as a relationship of "still image>moving image" when the modulation ranges are arranged on the basis of images.

As shown in FIG. 19, according to an aspect of the disclosure, frequency dispersion of clock signals depending on the position of the display panel 150 can be achieved. Modulation based on the center area of the display panel 150 as shown in FIG. 19 can be exemplified for description of frequency dispersion of clock signal depending on positions.

An existing frequency according to the experimental example is fixed, whereas a frequency according to the aspect is varied for at least one period. As can be ascertained through the illustrated varied frequency, a modulation range (frequency modulation range) increases with decreasing distance from the center area of the display panel 150 to the ends of the upper area and the lower area. Here, modulation ranges of the upper area and the lower area of the display panel 150 have the same value on the basis of the center area and can gradually increase. On the contrary, the frequency may be varied in a form in which the center area of the display panel 150 is protruded more than the upper area and the lower area of the display panel 150.

Furthermore, in frequency dispersion of clock signals depending on positions, frequencies may be varied in a form in which the center area of the display panel 150 is further protruded compared to the upper area and the lower area of the display panel 150, as shown in FIG. 20(A). Here, the modulation ranges of the upper area and the lower area of the display panel 150 have the same value on the basis of the center area and can gradually decrease.

In addition, in frequency dispersion of clock signals depending on positions, frequencies may be varied in a form in which the center area of the display panel 150 is recessed in a concave form and the upper area and the lower area of the display panel 150 are protruded in a convex form, as shown in FIG. 20(B). Furthermore, in frequency dispersion of clock signals depending on positions, frequencies may be varied in various patterns including random patterns.

Therefore, frequency dispersion of clock signals depending on positions can cause frequencies of clock signals to be varied in accordance with an external environment and/or an internal environment of the display panel rather than characteristics of an image, and thus frequency dispersion of clock signals depending on positions is not limited to the illustrated patterns.

As shown in FIG. 21, the disclosure is based on experiments of frequency dispersion of clock signals on the basis of a component capable of delaying clock signals, such as "GCLK Delay". In FIG. 21, 1H represents whether clock signals are fixed or varied and 4H represents whether periods are fixed or varied.

In diagram (A) of FIG. 21, an experimental example represents a method in which both clock signals and periods are fixed. As results of realization of a scan driver and measurement of EMI on the basis of the experimental example, 38 dB has been obtained.

In diagram (B) of FIG. 21, a first aspect represents a method in which only clock signals are varied. As results of realization of a scan driver and measurement of EMI on the basis of the first aspect (b), 35 dB has been obtained (3 dB has decreased compared to the experimental example).

In diagram (C) of FIG. 21, a second aspect represents a method in which only periods are varied with clock signals fixed. As results of realization of a scan driver and measurement of EMI on the basis of the second aspect, 36 dB has been obtained (2 dB has decreased compared to the experimental example).

In diagram (D) of FIG. 21, a third aspect represents a method in which both clock signals and periods are varied. As results of realization of a scan driver and measurement of EMI on the basis of the third aspect, 32 dB has been obtained (6 dB has decreased compared to the experimental example).

As can be ascertained through the above-described four examples, a desirable method by which EMI can be minimized through clock signal dispersion is the third aspect. In addition, a method of referring to a screen pattern or positions vulnerable to EMI in order to minimize the influence on picture quality (picture quality deterioration) may be added to the first to third aspects.

Figure 22:
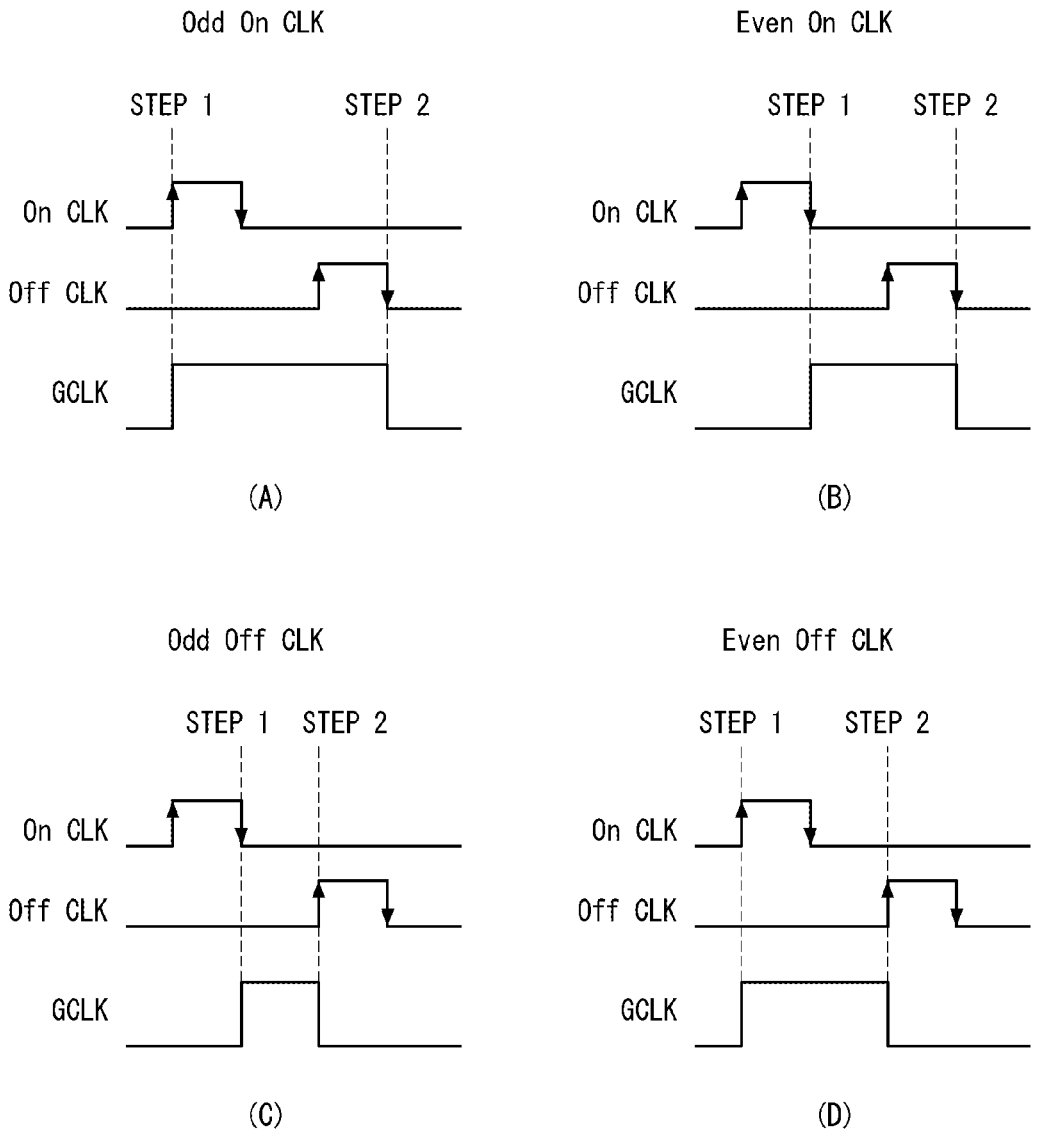
FIG. 22 consists of diagrams for describing a clock signal control signal composed of an on clock and an off clock and examples of modulation of clock signals using the same according to an aspect of the present disclosure.
Figure 23:
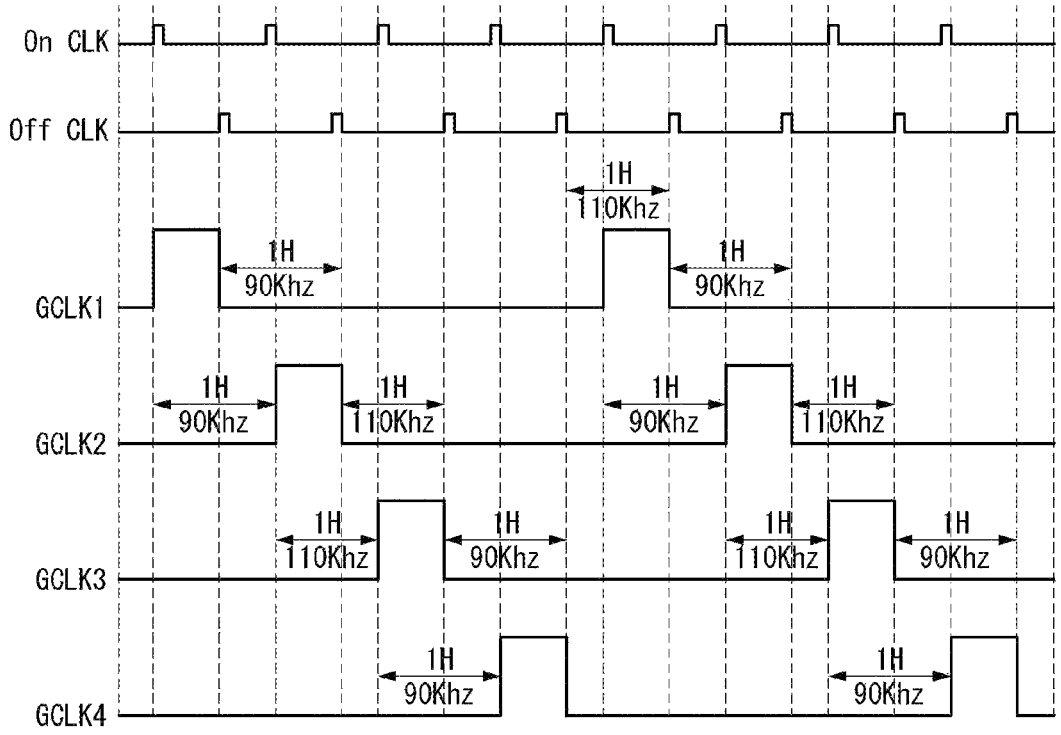
FIGS. 23 and 24 are diagrams for describing examples of modulation of clock signals according to a clock signal control signal composed of an on clock and an off clock.
Figure 24:
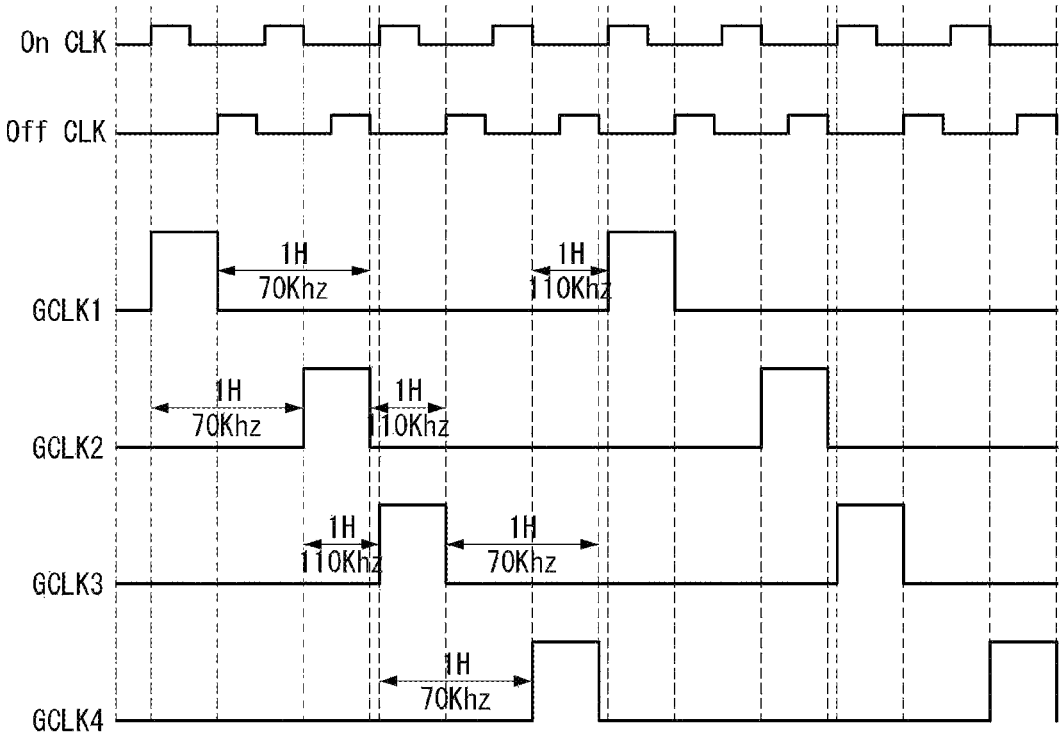
Figure 25A:
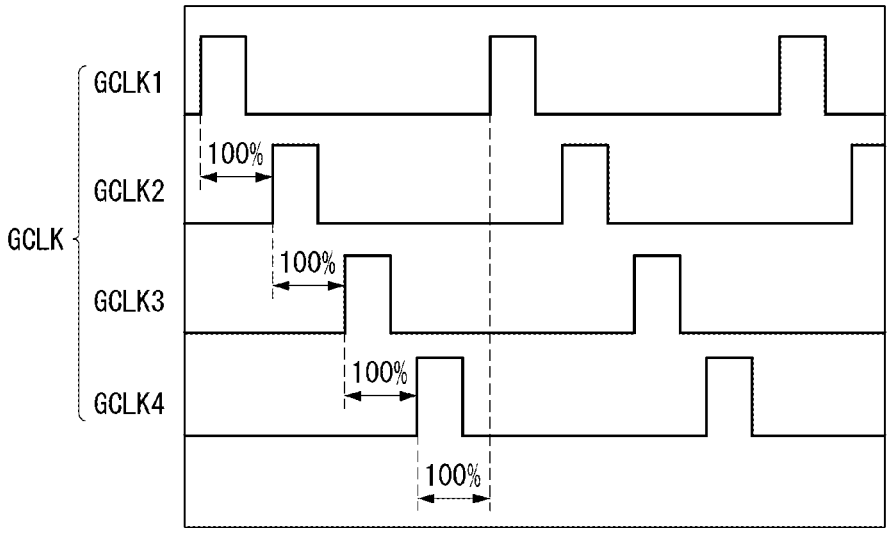
FIGS. 25A to 25B and FIGS. 26A to 26B are diagrams for respectively describing electromagnetic interference measurement results in the experimental example of FIG. 7 and the present disclosure of FIG. 9 using graphs.
Figure 25B:
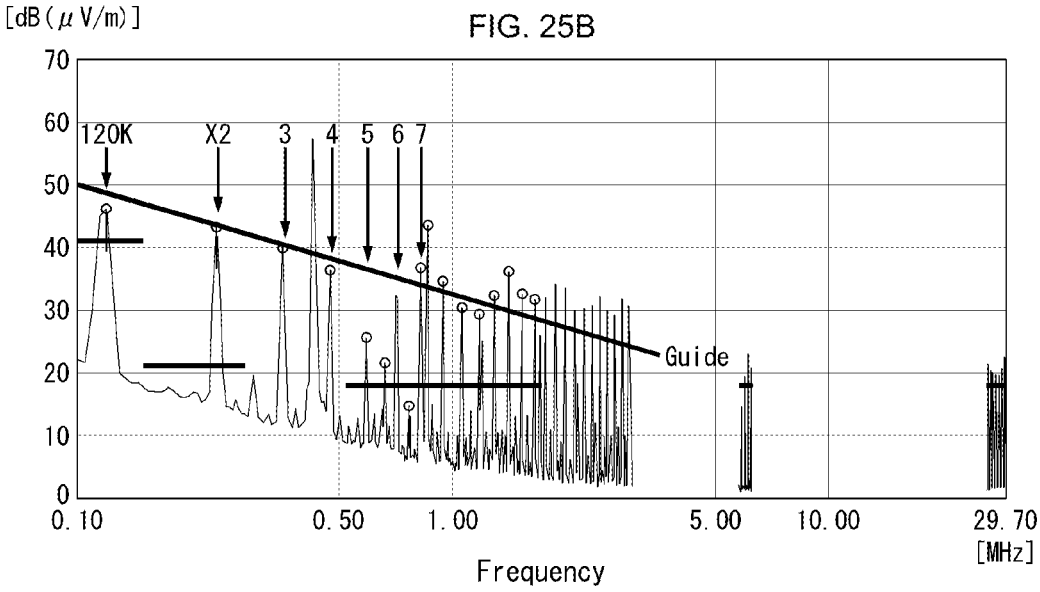
Figure 26A:
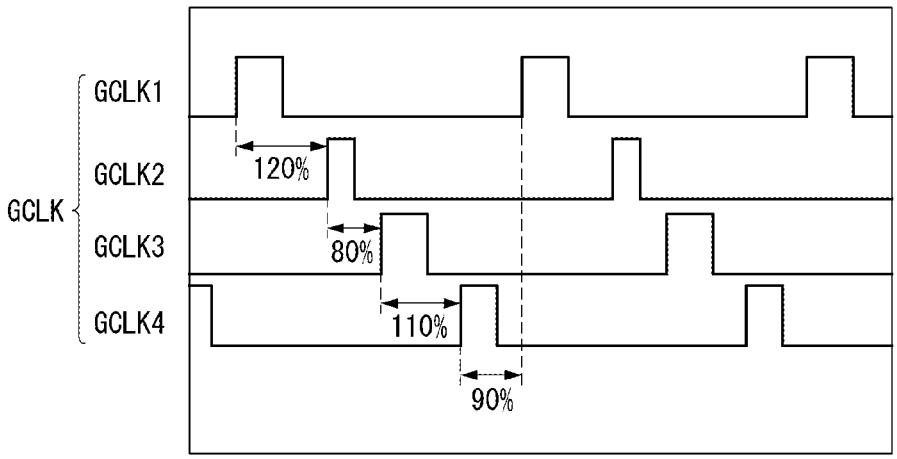
Figure 26B:
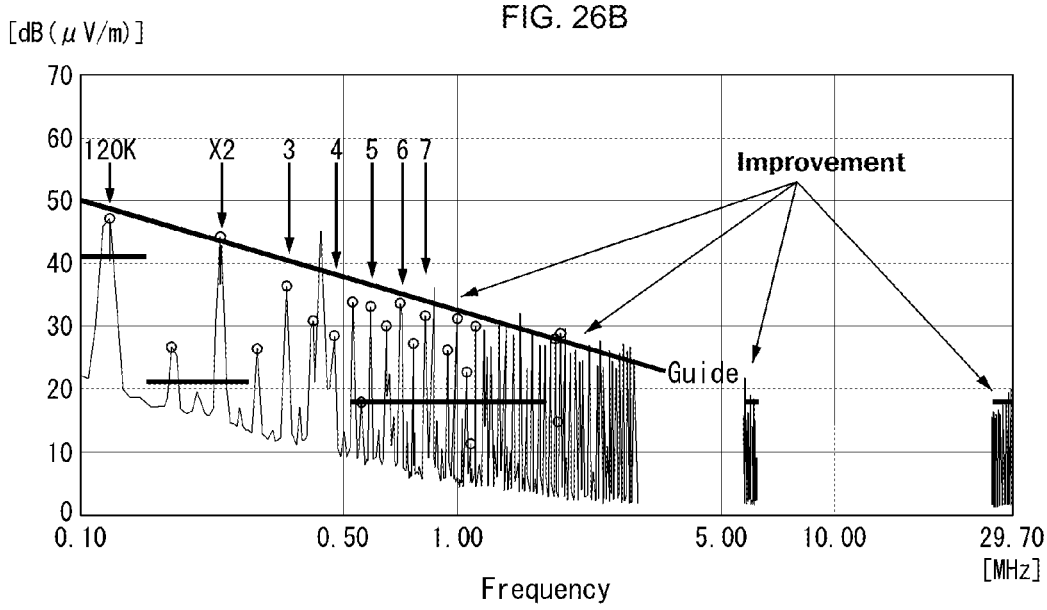

FIG. 22 consists of diagrams for describing a clock signal control signal composed of an on clock and an off clock and examples of modulation of clock signals using the same according to an aspect of the disclosure, FIGS. 23 and 24 are diagrams for describing examples of modulation of clock signals according to the clock signal control signal composed of an on clock and an off clock, and FIGS. 25A to 25B and FIGS. 26A to 26B are diagrams for comparatively describing EMI measurement results in the experimental example of FIG. 7 and the aspect of FIG. 9 using graphs.

As shown in FIG. 22, according to an aspect of the disclosure, the clock signal control signal used for modulation of clock signals can be composed of an on clock On CLK and an off clock Off CLK. The on clock On CLK and the off clock Off CLK have a logic high level and a logic low level and logic high durations thereof do not overlap.

As shown in diagram (A) of FIG. 22, a logic high of a clock signal GCLK can occur in response to the rising edge of the on clock On CLK (STEP1) and a logic low of the clock signal GCLK can occur in response to the falling edge of the off clock Off CLK (STEP2).

As shown in diagram (B) of FIG. 22, a logic high of the clock signal GCLK can occur in response to the falling edge of the on clock On CLK (STEP1) and a logic low of the clock signal GCLK can occur in response to the falling edge of the off clock Off CLK (STEP2).

As shown in diagram (C) of FIG. 22, a logic high of the clock signal GCLK can occur in response to the falling edge of the on clock On CLK (STEP1) and a logic low of the clock signal GCLK can occur in response to the rising edge of the off clock Off CLK (STEP2).

As shown in diagram (D) of FIG. 22, a logic high of the clock signal GCLK can occur in response to the rising edge of the on clock On CLK (STEP1) and a logic low of the clock signal GCLK can occur in response to the rising edge of the off clock Off CLK (STEP2).

FIG. 22 shows an example in which occurrence timings of a logic high and a logic low of the clock signal GCLK can be controlled in response to the rising edges or falling edges of an odd on clock On CLK and an odd off clock Off CLK or the rising edges or falling edges of an even on clock On CLK and an even off clock Off CLK. That is, on clocks On CLK and off clocks Off CLK are divided into an odd on clock On CLK and an odd off clock Off CLK and an even on clock On CLK and an even off clock Off CLK, and occurrence timings of a logic high and a logic low of the clock signal GCLK can be controlled in synchronization with edges (rising edges or falling edges) thereof.

As shown in FIG. 23, logic high and logic low of first and third clock signals GCLK1 and GCLK3 respectively occur in response to the rising edge of an on clock On CLK and the rising edge of an off clock Off CLK. On the other hand, logic high and logic low of second and fourth clock signals GCLK2 and GCLK4 respectively occur in response to the falling edge of an on clock On CLK and the falling edge of an off clock Off CLK.

When the 4-phase clock signals GCLK1 to GCLK4 are generated under different conditions as described above, frequency differences can be generated between odd clock signals GCLK1 and GCLK3 and even clock signals GCLK2 and GCLK4. For example, logic high occurrence timings of the first clock signal GCLK1 and the second clock signal GCLK2 has a difference of 90 kHz therebetween, whereas logic high occurrence timings of the second clock signal GCLK2 and the third clock signal GCLK3 has a difference of 110 kHz therebetween.

As can be ascertained through the example of FIG. 23, when occurrence timings of logic high and logic low of a clock signal GCLK are controlled using the rising edges or falling edges of an on clock On CLK and an off clock Off CLK according to whether the on clock On CLK and the off clock Off CLK are odd clocks or even clocks or how many on clocks and off clocks exist before the on clock and the off clock, frequency dispersion of clock signals can be achieved as described above.

As shown in FIG. 24, logic high and logic low of the first and third clock signals GCLK1 and GCLK3 respectively occur in response to the rising edge of an on clock On CLK and the rising edge of an off clock Off CLK. On the other hand, logic high and logic low of the second and fourth clock signals GCLK2 and GCLK4 respectively occur in response to the falling edge of an on clock On CLK and the falling edge of an off clock Off CLK.

The example of FIG. 24 is substantially the same as the example of FIG. 23, and the 4-phase clock signals GCLK1 to GCLK4 are generated in the same manner. However, a logic high duration and a logic low duration of the on clock On CLK and the off clock Off CLK in the example of FIG. 24 differ from those in the example of FIG. 23. That is, the logic high duration and the logic low duration of the on clock On CLK and the off clock Off CLK can also be varied.

As can be ascertained through the example of FIG. 24, a method of varying a logic high duration and a logic low duration of an on clock On CLK and an off clock Off CLK differently can be added for varying frequencies of the clock signals GCLK1 to GCLK4. For example, logic high occurrence timings of the first clock signal GCLK1 and the second clock signal GCLK2 has a difference of 70 kHz therebetween, whereas logic high occurrence timings of the second clock signal GCLK2 and the third clock signal GCLK3 has a difference of 110 kHz therebetween.

Therefore, as can be ascertained through the example of FIG. 24, a combination of the method of using falling edges and rising edges of an on clock On CLK and an off clock Off CLK constituting the clock signal control signal, the method of discriminately using odd on clock and off clock and even on clock and off clock, and the method of varying a logic high duration and a logic low duration of the on clock On CLK and the off clock Off CLK differently may be used a method of varying the frequencies of the clock signals GCLK1 to GCLK4.

FIGS. 25A to 25B and FIGS. 26A to 26B show results obtained by applying clock signals provided on the basis of the experimental example of FIG. 7 and the aspect of FIG. 9 to an FPGA test board and measuring EMI. As can be ascertained through comparison between FIGS. 25A to 25B and FIGS. 26A to 26B, when the frequencies of the clock signals are varied as in the aspect, EMI can be improved compared to the experimental example by reducing, mitigating or eliminating points that deviate a guide related to EMI.

As described above, it is possible to minimize EMI while maintaining display quality (minimizing picture quality deterioration) through frequency dispersion of clock signals (scan signals) which considers a data signal charging rate as well as a screen pattern or positions vulnerable to EMI according to the disclosure. In addition, the disclosure can provide a scan driver robust against EMI and a display device using the same through frequency dispersion of clock signals (scan signals).

What is claimed is:

1. A scan driver comprising:

a level shifter configured to output a plurality of varied clock signals that have different frequencies for at least two consecutive periods; and a shift register configured to operate based on the plurality of clock signals and outputting scan signals, wherein each clock signal is frequency modulated by fixing pulse width of each clock signal and varying lengths of the at least two consecutive periods.

2. The scan driver of claim 1, wherein at least one of the plurality of clock signals has a pulse width different from a pulse width of at least one of other clock signals.

3. The scan driver of claim 1, wherein the level shifter assigns at least two clock signals as one pair during a same period and varies a pulse width of the plurality of clock signals.

4. The scan driver of claim 3, wherein, when the pulse width of one of the clock signals increases, the level shifter outputs the clock signals with varied pulse widths by decreasing the pulse width of the other clock signal.

5. The scan driver of claim 1, wherein, when the length of one period of the at least two consecutive periods increases, the level shifter decreases the length of the other period.

6. The scan driver of claim 1, wherein the shift register outputs scan signals dispersed in multiple frequency bands.

7. A display device comprising:

a scan driver configured to output scan signals dispersed in multiple frequency bands;

a data driver configured to output data signals;

a timing controller configured to control the scan driver and the data driver; and a display panel configured to display an image based on the scan signals and the data signals, wherein the scan driver comprises:

a level shifter configured to output a plurality of clock signals for at least two consecutive periods; and a shift register configured to operate based on the plurality of clock signals and output scan signals, wherein each clock signal is frequency modulated by fixing pulse width of each clock signal and varying lengths of the at least two consecutive periods.

8. The display device of claim 7, further comprising a clock signal controller configured to generate a frequency modulation value based on at least one of image information displayed on the display panel and positional information of the display panel and to provide a clock signal control signal for causing frequency dispersion with respect to the scan signals based on the frequency modulation value to the level shifter.

9. The display device of claim 8, wherein the clock signal controller controls frequency modulation ranges of scan signals applied to a center area of the display panel, an upper area of the display panel and a lower area of the display panel such that the frequency modulation ranges become different based on the at least one of image information displayed on the display panel and the positional information of the display panel.

10. The scan driver of claim 7, wherein the level shifter assigns at least two clock signals as one pair during a same period and varies a pulse width of the plurality of clock signals.

11. The scan driver of claim 10, wherein, when the pulse width of one of the clock signals increases, the level shifter outputs the clock signals with varied pulse widths by decreasing the pulse width of the other clock signal.

12. The display device of claim 7, wherein the level shifter varies the periods of the clock signals in such a manner that, when the length of one period of the at least two consecutive periods increases, the length of the other period decreases.

13. The display device of claim 8, wherein the clock signal controller generates the clock signal control signal with an on clock and an off clock respectively having a logic high and a logic low, and logic high durations of the on clock and the off clock are do overlap each other.

14. The display device of claim 11, wherein the level shifter outputs varied clock signals that have different frequencies in response to edges of the on clock and the off clock.

15. The display device of claim 14, wherein the clock signals become a logic high in response to a rising edge of the on clock and a logic low in response to a falling edge of the off clock, become a logic high in response to a falling edge of the on clock and a logic low in response to the falling edge of the off clock, become a logic high occurring in response to the falling edge of the on clock and a logic low in response to a rising edge of the off clock, or become a logic high in response to the rising edge of the on clock and a logic low in response to the rising edge of the off clock.

16. The display device of claim 13, wherein durations of the logic high and the logic low constituting the on clock and the off clock are variable.

17. A display device comprising:

a scan driver configured to output scan signals that have at least two different frequency bands;

a data driver configured to output data signals;

a timing controller configured to control the scan driver and the data driver;

a display panel configured to display an image on the basis of the scan signals and the data signals; and a clock signal controller configured to generate a frequency modulation value based on at least one of image information displayed on the display panel and positional information of the display panel and to provide a clock signal control signal for causing frequency dispersion with respect to the scan signals based on the frequency modulation value to the scan driver, wherein the clock signal controller varies a length of a period of the scan signals.

* * * * *